US010301084B2

(12) United States Patent
Rosendaal et al.

(10) Patent No.: US 10,301,084 B2
(45) Date of Patent: May 28, 2019

(54) CONTAINER SPOUT

(71) Applicant: GEORG MENSHEN GmbH & Co. KG, Finnentrop (DE)

(72) Inventors: Jean-Paul Rosendaal, 'S-Hertogenbosch (NL); Jan Wommelsdorf, Kirchhundem (DE); Walter Schulte, Finnentrop (DE); Frank Roemer, Finnentrop (DE)

(73) Assignee: GEORG MENSHEN GMBH & CO. KG, Finnentrop (DE)

( * ) Notice: Subject to any disclaimer, the term of this patent is extended or adjusted under 35 U.S.C. 154(b) by 94 days.

(21) Appl. No.: 15/502,940

(22) PCT Filed: Sep. 18, 2015

(86) PCT No.: PCT/EP2015/001866
§ 371 (c)(1),
(2) Date: Feb. 9, 2017

(87) PCT Pub. No.: WO2016/070949
PCT Pub. Date: May 12, 2016

(65) Prior Publication Data

US 2017/0275064 A1 Sep. 28, 2017

(30) Foreign Application Priority Data

Nov. 3, 2014 (DE) ..... 10 2014 016 178

(51) Int. Cl.
*B65D 47/28* (2006.01)
*B65D 75/58* (2006.01)
(Continued)

(52) U.S. Cl.
CPC ..... *B65D 47/283* (2013.01); *B65D 41/58* (2013.01); *B65D 47/247* (2013.01);
(Continued)

(58) Field of Classification Search
CPC .... B65D 41/58; B65D 47/283; B65D 47/247; B65D 51/226; B65D 51/228;
(Continued)

(56) References Cited

U.S. PATENT DOCUMENTS 4,394,923 A * 7/1983 Sugiyama ..... B65D 41/28 215/329
4,583,652 A 4/1986 Goldberg
(Continued)

FOREIGN PATENT DOCUMENTS

DE 29716230 U 1/1998
DE 102008034595 A 1/2010
(Continued)

*Primary Examiner* — Paul R Durand
*Assistant Examiner* — Andrew P Bainbridge
(74) *Attorney, Agent, or Firm* — Andrew Wilford

(57) ABSTRACT

The invention relates to a pourer (1) of a container comprising a pouring nozzle (2) which forms a pouring channel and on the external thread (3) of which a covering cap (4) is screwed. A sealing stopper (6) which closes the pouring channel is guided non-rotatably and is vertically displaceable in the pouring channel of the pouring nozzle. The sealing stopper (6) is retained on the cap which is rotatable relative thereto, such that a screwing on of the cap leads to a lifting of the sealing stopper (6) in the pouring channel. The cap (4) has an upper opening in which the sealing stopper (6) lies with the upper end thereof. The upper end of the sealing stopper (6) has at least one tamper-evident part (7) which breaks off or breaks up when the cap is unscrewed relative to the non-rotatably retained sealing stopper.

14 Claims, 1 Drawing Sheet

(51) Int. Cl.
*B65D 41/58* (2006.01)
*B65D 51/22* (2006.01)
*B65D 47/24* (2006.01)

(52) U.S. Cl.
CPC ..... *B65D 51/226* (2013.01); *B65D 51/228* (2013.01); *B65D 75/5861* (2013.01); *B65D 75/5883* (2013.01); *B65D 2101/0023* (2013.01); *B65D 2251/0015* (2013.01); *B65D 2251/0093* (2013.01)

(58) Field of Classification Search
CPC ..... B65D 75/5861; B65D 75/5883; B65D 2101/0023; B65D 2251/0015; B65D 2251/0093
USPC ..... 222/80–83.5, 89–91, 519–525, 531–532, 222/541.6–541.8, 544–546
See application file for complete search history.

(56) References Cited

U.S. PATENT DOCUMENTS 4,813,578 A * 3/1989 Gordon ..... B65D 5/749 220/258.3
4,884,705 A * 12/1989 Debetencourt ..... B65D 47/242 215/250
5,094,361 A * 3/1992 Dubach ..... B65D 47/36 215/235
5,348,184 A * 9/1994 Adams ..... B65D 5/749 215/213
5,433,982 A * 7/1995 Yamada ..... B32B 27/08 428/35.7
5,851,608 A * 12/1998 Yamada ..... B32B 27/10 428/34.2
6,000,848 A * 12/1999 Massioui ..... B65D 75/5883 215/306
6,257,463 B1 * 7/2001 De Polo ..... B65D 41/3428 222/525
6,382,462 B1 * 5/2002 Ostergaard-Nielsen ..... B65D 5/749 222/1
6,772,910 B1 * 8/2004 Coory ..... B65D 47/242 222/153.05
7,036,683 B2 * 5/2006 Dubach ..... B65D 5/748 222/83
7,506,784 B2 * 3/2009 Lee ..... B65D 47/061 206/222
7,850,044 B2 * 12/2010 Hildebrand ..... B65D 75/5883 220/604
8,329,309 B2 * 12/2012 Leplatois ..... B29C 47/0021 206/462
8,505,760 B2 * 8/2013 Ott ..... B65D 5/748 215/253
9,611,079 B2 * 4/2017 Mazurkiewicz ..... B65D 47/123
9,862,531 B2 * 1/2018 Johnson ..... B65D 75/5877
9,975,681 B2 * 5/2018 Johnson ..... B65D 47/2018
2006/0144852 A1 * 7/2006 Dubach ..... B65D 5/748 222/83
2006/0144875 A1 * 7/2006 Etesse ..... B05B 11/047 222/494
2009/0139882 A1 * 6/2009 DeJonge ..... B65D 51/2892 206/219
2012/0181281 A1 * 7/2012 Ott ..... B65D 5/748 220/277
2016/0046427 A1 * 2/2016 Bellmore ..... B65D 75/5877 383/42

FOREIGN PATENT DOCUMENTS

DE 202014003192 A 2/2015
FR 1607914 A 3/1972
FR 2346235 A 10/1977
GB 2107290 A 4/1983

* cited by examiner

CONTAINER SPOUT

CROSS REFERENCE TO RELATED APPLICATIONS

This application is the US-national stage of PCT application PCT/EP2015/001866 filed 18 Sep. 2015 and claiming the priority of German patent application 102014016178.1 itself filed 3 Nov. 2014.

FIELD OF THE INVENTION

The invention relates to a closable spout of a container comprising a pouring tube that is open at the top and forms a pouring passage, with a closure cap being screwed on the outside thread with its internal thread screwed, wherein a sealing stopper that closes the pouring passage is inserted into the pouring passage of the pouring tube, so that it is vertically movable and is held on the cap in such a way that unscrewing the cap causes the sealing stopper to be raised.

BACKGROUND OF THE INVENTION

Such a spout is known from DE 10 2008 034 595 A1. With this known spout, the sealing stopper forms a drinking tube that can be raised by the closure cap and has openings at the side, so that after the drinking tube has been raised, it can be held in one's mouth to allow the liquid in the container to flow into one's mouth, in particular to suck it out. This known design has a tamper-indicating ring beneath the closure cap, such that it is broken open when the closure cap is unscrewed. The tamper-indicating ring is difficult to see due to its position beneath the closure cap, so that it is not always possible to ascertain immediately whether the closure has already been opened. When the closure cap is twisted off, the drinking tube can be rotated, so that it is impossible to achieve an absolutely secure seal.

OBJECT OF THE INVENTION

The object of the invention is to improve upon a spout of the type defined in the introduction, so that a tamper-proof seal with good visibility is obtained with a simple design and a few parts while maintaining a good seal and simple handling.

SUMMARY OF THE INVENTION

This object is achieved according to the invention by the fact that

- the sealing stopper is guided in a rotationally fixed manner in the pouring passage of the pouring tube, the cap has, instead of an upper end wall, an upper opening in which the sealing stopper is inserted at its upper end, and
- the upper end of the sealing stopper has at least one tamper-proof part that is broken off or broken open when the cap is unscrewed in comparison with the sealing stopper that is held so that it cannot rotate.

The tamper-proof part on the top side of the cap is arranged, so that it is readily visible, so it is especially easy to recognize whether the closure has already been opened. Furthermore, this achieves a good seal with a simple design and ease of handling.

A particularly high degree of imperviousness and thus a secure oxygen barrier are achieved when the lower end of the sealing stopper is connected to a film that seals the pouring passage and tears open when the sealing stopper is lifted. Additional advantageous embodiments of the invention are defined in the dependent claims.

BRIEF DESCRIPTION OF THE DRAWING

An embodiment of the invention is illustrated in the drawings and described in greater detail below.

SPECIFIC DESCRIPTION OF THE INVENTION

Figure 1:
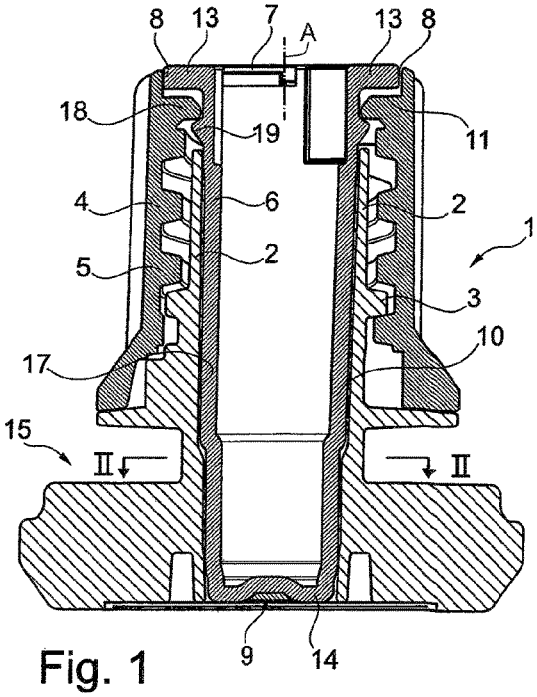
FIG. 1 is a vertical axial section through the spout/closure.
Figure 2:
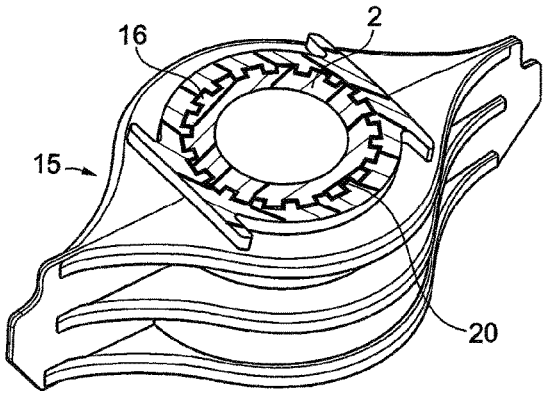
FIG. 2 is a section according to line II-II in FIG. 1 in a perspective diagram.
Figure 3:
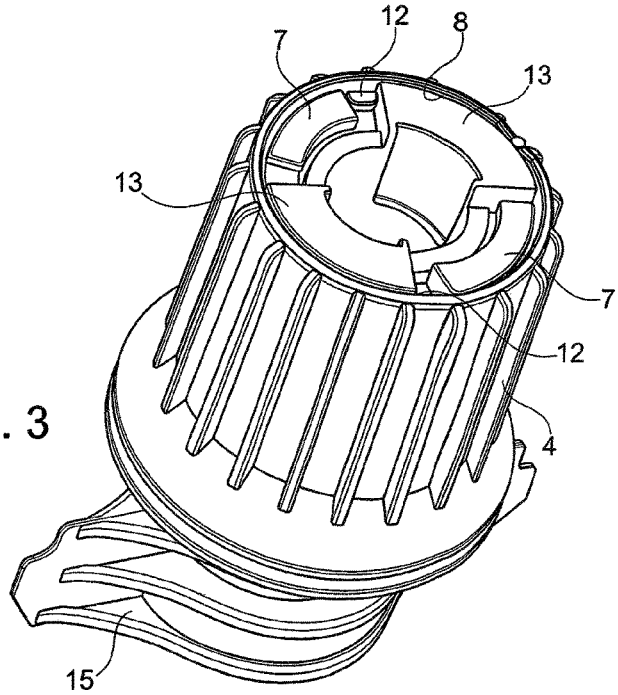
FIG. 3 is a perspective view of the entire spout/closure.

A plastic spout 1 has a cylindrical pouring tube 2 that is integrally welded on a welded-on part 15 at its lower end whose exterior is formed like a small boat in that the two exterior sides of the welded-on part are outwardly convex and taper to a point at both ends. The welded-on part 15 is welded between the walls of a bag with these exterior sides.

The pouring tube 2 forms an substantially cylindrical pouring passage 17 that extends over the entire length of the pouring connection and the welded-on part 15 and is inserted in a form-fitting manner into a substantially cylindrical sealing stopper 6. The sealing stopper 6 ends in an outwardly projecting flange and/or annular extension 13 at the top.

A closure cap 4 is unscrewed from the pouring tube 2 from above. To do so, the pouring tube 2 has an external thread 3 fitting with an internal thread 5.

The cap 4 is open at the top and thus forms an upper opening 8 with a partially annular coaxial recess 11 in which the widened portion or flange 13 fits complementarily. A coaxial inner ring 13 formed on an inner surface of the cap 4 engages underneath the widened portion 13 so that, when the cap 4 is unscrewed, it pulls the sealing stopper 6 upward. In doing so, a coaxial ring 19 projecting inward from an outer surface of the sealing stopper 6 engages the inside ring 18 from underneath on its lower face so that the sealing stopper 6 is held in the cap 4 and cannot be lost.

The sealing stopper 6 is guided without rotation in the pouring passage 17 of the pouring tube 2 by axially parallel ridges 16 on the outside of the sealing stopper 6 engaging into complementary parallel grooves 20 of the pouring tube 2 and/or of the inner passage of the welded-on part 15*d*. Thus, when the cap 4 is pulled up, the sealing stopper 6 is also raised without rotating.

The sealing stopper 6 extends to the lower end of the welded-on part 15, forming a lower wall 14 sealing the hollow stopper there. This lower end of the sealing stopper is connected to a film 9 that is attached to the lower end of the welded-on part to close the pouring passage 17. The film 9 tears when the sealing stopper is raised. The film 9 is preferably made of a film laminate with an aluminum layer that is in the middle or on back face of the laminate so that the aluminum layer cannot come into direct contact with the product bottled in the container.

Instead of having an upper wall, the sealing cap 4 has the upper opening 8 into which the sealing stopper 6 is inserted at its upper end to close the opening. The upper end of the sealing stopper 6 here has at least one tamper-indicating part 7 that breaks off or breaks open when the cap 4 is unscrewed relative to the sealing stopper that is held against rotation. This tamper-indicating part is formed by a partial flange 7 of the sealing stopper 6 that is inserted into an annular or partly annular recess 11 in the upper inner edge of the cap 4.

Since the flange 7 forming the tamper-indicating seal is connected to the flange 13 of the sealing stopper 6 by a bridge 12 that can be broken or torn. If the cap 4 is twisted relative to the widened portion 13 that is held against rotation, then a projection on the inside of the upper opening 8 of the cap abuts against the tamper-indicating widened portion 7, so that the widened portion 7 is bent to the extent that the bridge 12 breaks off or tears. Therefore, on the top side of the cap 4, one can see whether the spout has already been opened or is still unused.

In an alternative embodiment (not shown here), the spout is not integrally welded on a welded-on part but instead is attached to a rigid plastic container, in particular a plastic bottle.

The invention claimed is:

1. A closable spout for a container comprising:

a tube that extends along an upright axis, has an external thread, forms a passage, and is upwardly open;

a cap screwed onto the thread and having an upper end formed with an upper opening;

a stopper engageable downwardly through the opening to close the passage of the tube, and vertically axially movable in the passage by unscrewing of the cap;

interfitting axially extending formations on the stopper and on the tube inhibiting the stopper from rotating in the tube; and a tamper-indicating part on an upper end of the stopper constructed and arranged so as to break, separate from the tube, or separate from each other when the cap is unscrewed from the stopper that is held by the formations.

2. The spout according to claim 1, further comprising:

a film connected to the lower end of the stopper, closing the passage, and tearing when the stopper is raised.

3. The spout according to claim 2, wherein the stopper is closed with a lower wall on a lower end of the cylindrical side wall.

4. The spout according to claim 3, wherein at least an edge of the lower wall is attached to the film closing the passage.

5. The spout according claim 2, wherein the film is of plastic or aluminum.

6. The spout according to claim 5, wherein the film is a film laminate with an aluminum layer not in direct contact with the bottled product.

7. The spout according to claim 2, further comprising:

a welded-on part unitary with the tube, the passage extending over a total height of the tube and of the welded-on part.

8. The spout according to claim 7, wherein the film is attached to a lower end of the welded-on part.

9. The spout according to claim 1, wherein the stopper has an upper end formed with a flange having a tamper-indicating widened portion set into an at least partially annular recess in which the flange fits at an inner upper edge of the cap.

10. The spout according to claim 1, wherein the tamper-indicating widened portion is partially annular in shape.

11. The spout according to claim 10, further comprising:

a frangible bridge connecting the tamper-indicating widened portion to the flange of the stopper.

12. The spout according to claim 10, further comprising:

at least one projecting formation on the cap and abutting against the tamper-indicating widened portion when the cap is unscrewed in order to break open and/or bend the tamper-indicating part.

13. The spout according to claim 1, wherein the stopper has a cylindrical side wall.

14. The spout according to claim 1, wherein the stopper is connected to the cap so that the cap cannot be separated therefrom and is removable as a cohesive part by the tube.

* * * * *